United States Patent [19]

Kablaoui et al.

[11] 4,024,083

[45] May 17, 1977

[54] SUBSTITUTED PHENOXY PROPANOL DIAMINES AND AMINO ALCOHOL DETERGENT ADDITIVES FOR FUELS AND MINERAL OILS

[75] Inventors: Mahmoud S. Kablaoui; Joseph B. Biasotti, both of Wappingers Falls, N.Y.

[73] Assignee: Texaco Inc., New York, N.Y.

[22] Filed: Mar. 8, 1976

[21] Appl. No.: 665,031

[52] U.S. Cl. ..... 252/51.5 R; 44/75; 260/570.7

[51] Int. Cl.[2] ..... C10M 1/22; C10M 1/34; C10L 1/18; C07C 93/06

[58] Field of Search ..... 252/51.5 R; 260/570.7 R, 570.7 OH; 44/75

[56] References Cited

UNITED STATES PATENTS

| | | | |
|---|---|---|---|
| 2,723,906 | 11/1955 | Rogers et al. | 44/75 X |
| 2,817,675 | 12/1957 | Hofer et al. | 260/570.7 OH X |
| 3,038,856 | 6/1962 | Milligan | 260/570.7 R X |
| 3,075,832 | 1/1963 | Ecke et al. | 44/78 |
| 3,340,192 | 9/1967 | Henley | 252/51.5 R |

OTHER PUBLICATIONS

Wasson et al., CA 72:43108v, (1970).

*Primary Examiner*—Daniel E. Wyman
*Assistant Examiner*—Thomas A. Waltz
*Attorney, Agent, or Firm*—Thomas H. Whaley; Carl G. Ries; James J. O'Loughlin

[57] ABSTRACT

Detergent additive represented by the formula:

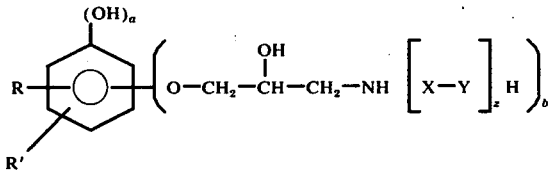

in which R is a hydrocarbyl radical having a molecular weight ranging from about 200 to 1500, R′ is hydrogen or an alkyl radical having from 1 to 4 carbon atoms, X is a divalent hydrocarbon radical having from 2 to 6 carbon atoms, Y is NH or O, *a* has a value from 0 to 1, *b* has a value from 1 to 2 with the sum of *a* and *b* not exceeding 2, and *z* has a value from 1 to 10, and a mineral composition containing the detergent additive.

11 Claims, No Drawings

SUBSTITUTED PHENOXY PROPANOL DIAMINES AND AMINO ALCOHOL DETERGENT ADDITIVES FOR FUELS AND MINERAL OILS

BACKGROUND OF THE INVENTION

1. Field of the Invention

Modern internal combustion gasoline engine design is undergoing important changes to meet stricter standards concerning engine and exhaust gas emissions. One major change in engine design is the feeding of blow-by gases from the crankcase zone of the engine into the intake air-fuel mixture at the carburetor just below the throttle plate, rather than venting these gases to the atmosphere as in the past. The blow-dry gases contain substantial amounts of deposit forming substances and are known to form deposits in and around the throttle plate area of the carburetor. Another significant change is the recirculation of part of the exhaust gases to the fuel air intake of the engine. These exhaust gases also have deposit forming tendencies. The deposits caused by the recirculated gases, both blow-by and exhaust gases, restrict the flow of air through the carburetor at idle and at low speeds so that an overrich fuel mixture results. This condition produces rough engine idling and stalling and leads to the release of excessive hydrocarbon exhaust emissions to the atmosphere.

Other types of engines are being designed to meet the problem of exhaust emissions via fuel injection. Both diesel and gasoline engines have been developed which incorporated fuel injection. In these systems, the fuel is delivered in a precise quantity and over a precise time interval into the combustion zone of the engine by means of fuel injectors and the associated valves and pumps. This equipment is designed to very fine tolerances and is susceptible to breakdown with deposite formation. A detergent diesel or gasoline composition is effective for mitigating or preventing this problem.

An object of this invention is to provide a novel detergent additive.

Another object is to provide an improved liquid hydrocarbon composition.

2. Description of the Prior Art

U.S. Pat. No. 3,075,832 discloses hydrocarbon substituted hydroxy aromatic compounds and their effectiveness as antioxidants for organic materials subject to deterioration in the pressure of air.

SUMMARY OF THE INVENTION

The additive of the invention, which is effective as a detergent in a hydrocarbon oil composition is represented by the formula:

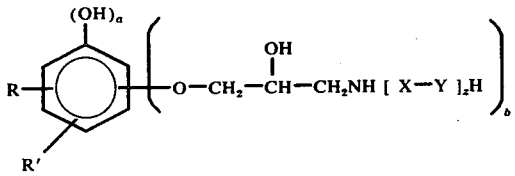

in which R is a hydrocarbon radical having a molecular weight ranging from about 200 to 1500, R′ is hydrogen or an alkyl radical having from 1 to 4 carbon atoms, X is a divalent hydrocarbon radical having from 2 to 6 carbon atoms, Y is NH or 0, *a* has a value from 0 to 1,

*b* has a value from 1 to 2 with the sum of *a* and *b* not exceeding 2, and *z* has a value from 1 to 10.

A preferred class of compounds of the invention because of their surprising effectiveness as detergents is represented by the formula:

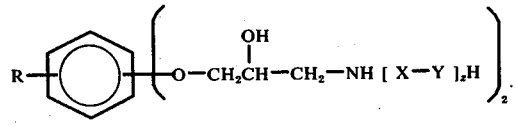

in which R has a molecular weight ranging from 250 to 1200, X and Y have the values noted above, and *z* has a value from 1 to 6.

A more preferred class of compounds of the invention is represented by the formula:

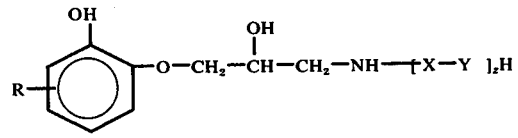

in which R has a molecular weight ranging from 250 to 1200 X and Y have the values noted above, and *z* has a value from 1 to 6.

The most preferred additive is that represented by the formula:

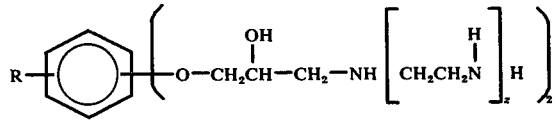

in which R has a molecular weight ranging from 300 to 1000 and *z* has a value from 2 to 5.

The preparation of the detergent additive of the invention is generally accomplished in two steps. The starting reactant is a hydrocarbon-substituted hydroxy aromatic compound represented by the formula:

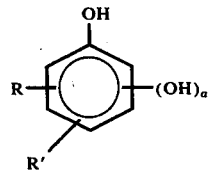

in which R is a hydrocarbon radical having a molecular weight ranging from about 200 to 1500 and *a* has a value from 0 to 1. Hydrocarbon radicals having the noted molecular weight range will have from about 15 to 105 carbon atoms. These radicals can be saturated or unsaturated hydrocarbon radicals. In general, any unsaturation will be limited or minor as is the case when the hydrocarbon radical is derived from an olefin polymer which will have usually only one or two unsaturated olefin linkages.

The preferred hydrocarbon radicals are those derived from an olefin having from two to four carbon atoms, such as ethylene, propylene, isobutylene, 1-butane and 2-butene or mixtures thereof which have been polymerized by a conventional method to a polymer of suitable molecular weight. Polyisobutylene radicals having a molecular weight from 200 to 1500 is the preferred souce of the hydrocarbon radical.

Included within the noted formula are the mono- and dihydrocarbon substituted, mono- and dihydroxy substituted aromatic radicals, such as the alkylated phenols and cathechols.

The alkylated phenol or catechol is reacted with epichlorohydrin in the first step of the reaction. In general one mole of alkylated phenol is reacted with one mole of epichlorohydrin. When a dihydroxy aromatic compound, such as an alkylated catechol, is employed, the reaction is conducted to effect a reaction with from one to two moles of the epichlorohydrin per mole of the dihydroxy aromatic compound. This is a conventional reaction and is generally conducted in the presence of a catalyst and solvent at an elevated temperature to produce an intermediate product.

The intermediate product is reacted with an amine or an aminoalcohol to form the effective detergent additive. Suitable amines include the alkylene polyamines and hydroxy-substituted amines such as ethylene diamine, diethylenetriamine, triethylene tetramine, tetraethylene pentamine, trimethylenediamine, tetramethylenediamine, pentaethylene hexamine, N-hydroxyethyl ethylene diamine.

In general, the intermediate product is reacted with the amine compound in from 1:1 to 1:2 or more molar proportions. The product is conveniently recovered and employed in a hydrocarbon solvent.

The following examples illustrate the preparation of specific additive compounds.

EXAMPLE I

Polyisobutenylcatechol (425 g. 1.0 mole), 95.0 g. (1.0 mole) of epichlorohydrin, 5.0 g. of boron trifluoride etherate and 400 ml. of xylene are heated to 100° C. for about 2 hours. Stripping of the solvent under vacuum (5 mm. of Hg. and 100° C) affords 520 g. of the intermediate. (Anal. % Cl — Found 7.2, Theory 7.1).

The above intermediate (300 g., 0.58 mole), diethylenetriamine (180 g., 1.75 mole) and 400 ml. of xylene are heated to 100° C for 5 hours. The mixture is then washed with 10/90 aqueous methanol solution containing 24.0 g. of sodium hydroxide. Stripping of the xylene layer under vacuum (5 mm. of Hg and 100° C), affords 300 g. of 2-hydroxy-3-(N-diethylenetriamine)propyl 2-hydroxy-polyisobutenyl (335) phenyl ether. Xylene is added to make a 50 weight percent concentrate. (Anal. % Cl — Found, 0.24, Theory 0.0).

EXAMPLE II

Polyisobutenyl (335 M.W.) catechol, (425 g., 1.0 mole), 190 g. (2.0 mole) of epichlorohydrin, 5.0 g. of boron trifluoride etherate and 400 ml. of xylene are treated as in the preparation of Example I and 610 g. of the intermediate is recovered.

(Anal. % Cl—Found 12.7, Theory 12.2).

The intermediate (370.0 g., 0.6 mole), diethylenetriamine (250 g., 2.5 mole) and 400 ml. xylene are treated as in the second step of the preparation of Example I. After work-up, 150 g. of 1,2-di-[2-hydroxy-3-(N-diethylenetriamine) propyl]polyisobutenyl (335) phenyl ether is isolated. 150 g. of xylene is added to make a 50 weight percent concentrate.

(Anal. % Cl—Found, 0.47, Theory 0.0).

EXAMPLE III

Polyisobutenylcatechol, (425 g., 1.0 mole), 95.0 g. (1.0 mole) of epichlorohydrin, 5.0 g. of boron trifluoride etherate and 400 ml of xylene are treated as in Example I above.

The intermediate (300 g., 0.58 mole), ethylenediamine (105.0 g., 1.75 mole) and 400 ml. of xylene are heated to 100° C for 5 hours. Work up as in Example I above affords 300 g. of 2-hydroxy-3-(N-ethylenediamine)-propyl-2-hydroxypolyisobutenyl (335) phenyl ether. Xylene (300 g) is added to make a 50 weight percent concentrate.

EXAMPLE IV

Same as Example III above except that 125.8 g (1.70 mole) of 1,3-propylenediamine is used instead of 105.0 g of ethylenediamine. After work up as in Example I, 300 g. of 2-hydroxy-3(1,3-propylenediamine)propyl 2-hydroxypolyisobutenyl (335) phenyl ether is isolated. Xylene is added to make 50 weight percent concentrate.

EXAMPLE V

Same as Example III above except that 106.7 g. of ethanolamine is used instead of 105.0 g. of ethylenediamine. After work up as in Example I above, 2-hydroxy-3-(N-monoethanolamine)propyl 2-hydroxypolyisobutenyl (335) phenyl ether is isolated. Xylene is added to make 50 weight percent concentrate.

The mineral oil composition of the invention comprises a mixture of hydrocarbons boiling in the range from about 80° to about 1000° F. containing an effective detergent amount of the prescribed compound. More specifically, the detergent is effective in a gasoline or motor fuel composition consisting of a mixture of hydrocarbons boiling from about 85° to 450° F, in a distillate fuel composition, such as kerosene, boiling from about 350° to 650° F, and in a mineral lubricating oil composition boiling from about 650° to 1000° F.

The gasoline motor fuel which is benefited by the additive of the invention may be leaded or unleaded and may consist of straight-chain or branched-chain paraffins, cycloparaffins, olefins, and aromatic hydrcarbons and mixtures of these. The base fuel can be derived from straight run naphtha, polymer gasoline, natural gasoline or from catalytically cracked or thermally cracked hydrocarbons and catalytically reformed stocks. The hydrocarbon composition and the octane level of the base fuel are not generally critical. Any conventional motor fuel base may be employed in the practice of this invention.

In general, the additive of the invention is added to a mineral oil composition in a minor amount, i.e., an amount effective to provide detergency to the oil composition. The additive is effective in a mineral oil in an amount ranging from about 0.001 to 5.0 weight percent based on the total composition. In a fuel composition, an amount ranging from about 0.001 to 0.2 weight percent is preferred with the most preferred concentration ranging from about 0.002 to0.10 weight percent. It is understood, of course, that the additive can be employed in an oil concentrate for ease of handling containing from about 5.0 to about 50 weight percent of the additive.

A fuel composition containing the additive of the invention can contain other additives normally employed in a fuel composition. For example, the base fuel may be blended with an anti-knock compound, such as tetraalkyl lead compound, including tetraethyl lead, tetramethyl lead, tetrabutyl lead, or mixtures thereof, generally in a concentration from about 0.01 to 4.0 cc. per gallon of gasoline. The tetraethyl lead mixture commercially available for automative use will also contain an ethylene chloride-ethylene bromide mixture as a scavenger for removing lead combustion products from the engine. The fuel composition may also be augmented with anti-icing additives, corrosion inhibitors, intake system deposits modifiers, dispersants, upper cylinder lubricants and the like.

The additive of the invention is tested for its effectivenes as a carburetor detergent in the Buick Carburetor Detergency Test. This test is run on a Buick 350 CID V-8 engine equipped with a two barrel carburetor. The engine is mounted on a test stand and has operating EGR and PVC systems. The test cycle, shown in Table I, is representative of normal road operation. Approximately 300 gallons of fuel and three quarts of oil are required for each run.

Prior to each run the carburetor is completely reconditioned. Upon completion of the run the throttle plate deposits are visually rated according to a CRC Varnish rating scale (Throttle Plate Merit Rating) where 1 describes heavy deposits on the throttle plate and 10 a completely clean plate.

TABLE I

1973 BUICK CARBURETOR DETERGENCY TEST OPERATING CONDITIONS

| | Stage I | Stage II | Stage III |
|---|---|---|---|
| Duration, hours | 1 | 3 | 1 |
| Speed, r.p.m. | 650±25 | 1500±25 | 2000±25 |
| Torque, ft.-lbs. | 0 | 80±2 | 108±2 |
| Water Out, ° F. | 205±5 | 205±5 | 205±5 |
| Carburetor Air, ° F. | 140±5 | 140±5 | 140±5 |
| Exhaust Back Pres., in Hg | — | 0.7±0.1 | — |
| Man. Vac., In. Hg | — | 15.8 | 14.2 |
| Fuel Flow, lbs/hr. | 0.7 | 7.5 | 12.0 |
| Test Duration, 120 hours | | | |

The Base Fuel employed for testing the detergent additive of the invention is a premium grade gasoline having a Research Octane Number of about 92. This gasoline consists of about 2.4% aromatic hydrocarbons, 10% olefinic hydrocarbons and 66% paraffinic hydrocarbons and boils in the range from 92° to 380° F. This base fuel gives a Throttle Plate Merit Rating of about 3.0 in the Buick Carburetor Detergency Test.

An additive fuel composition consisting of the Base Fuel described above containing 80 PTB (pounds per thousand barrels of fuel) of the compound of Example I substantially improves the Throttle Plate Merit Rating over that of the Base Fuel.

An additive fuel composition consisting of the Base Fuel containing 60 PTB of the compound of Example II provides a surprising improvement in the Throttle Plate Merit Rating over that of both the Base Fuel and the additive fuel containing the compound of Example I.

The improvement in the detergency property of the novel fuel compositions of the invention from the use of the novel detergent additives is a noteworthy advance in the provision of a modern detergent oil composition.

We claim:

1. A mineral oil composition comprising a mixture of hydrocarbons boiling in the range of about 80° to 1000° F. containing an effective detergent amount of a compound represented by the formula:

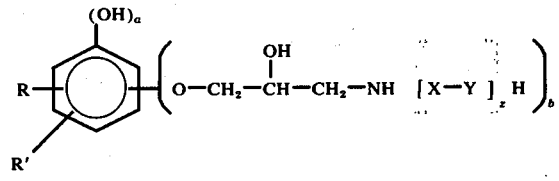

in which R is a hydrocarbon radical having a molecular weight ranging from about 200 to 1500, R′ is hydrogen or an alkyl radical having from 1 to 4 carbon atoms, X is a divalent hydrocarbon radical having from 2 to 6 carbon atoms, Y is NH or 0, *a* has a value from 0 to 1, *b* has a value from 1 to 2 with the sum of *a* and *b* not extending 2, and *z* has a value from 1 to 10.

2. A mineral oil composition comprising a mixture of hydrocarbons boiling in the range from about 80° to 1000° F containing an effective detergent amount of a compound represented by the formula:

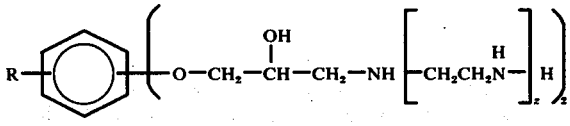

in which R has a molecular weight ranging from 300 to 1000 and *z* has a value from 2 to 5.

3. A composition according to claim 1 containing from about 0.001 to 5.0 weight percent of said compound.

4. A motor fuel composition comprising a mixture of hydrocabons in the gasoline boiling range containing an effective detergent amount of a compound represented by the formula:

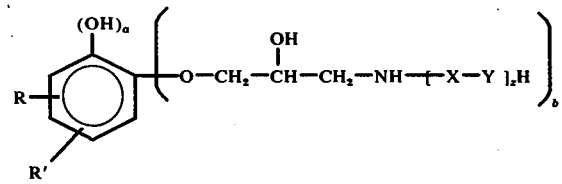

in which R is a hydrocarbon radical having a molecular weight ranging from about 200 to 1500, R′ is hydrogen or an alkyl radical having from 1 to 4 carbon atoms, X is a divalent hydrocarbon radical having from 2 to 6 carbon atoms, Y is NH or 0, *a* has a value from 0 to 1, *b* has a value from 1 to 2 with the sum of *a* and *b* not exceeding 2, and *z* has a value from 1 to 10.

5. A motor fuel composition according to claim 4 in which said compound has the formula:

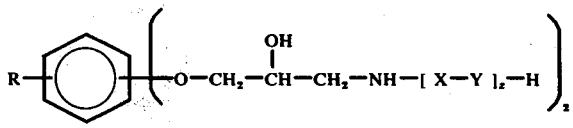

in which R has a molecular weight ranging from 250 to 1200, X is a divalent hydrocarbon radical having from 2 to 6 carbon atoms, Y is NH or 0, and *z* has a value from 1 to 6.

6. A motor fuel composition according to claim 4 in which said compound has the formula:

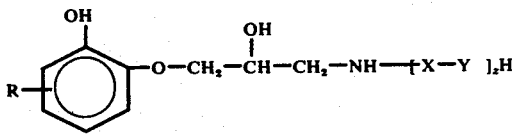

in which R has a molecular weight ranging from 250 to 1200, and $z$ has a value from 1 to 6.

7. A motor fuel composition according to claim 4 containing from about 0.001 to 0.2 weight percent of said compound.

8. The compound represented by the formula:

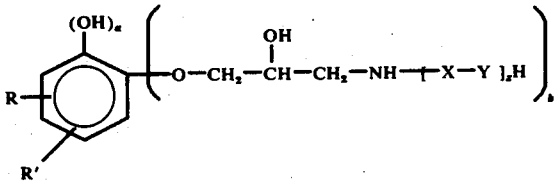

in which R′ is a hydrocarbon radical having from 1 to 4 carbon atoms, R is a hydrocarbon radical having a molecular weight ranging from about 200 to 1500, X is a divalent hydrocarbon radical having from 2 to 6 carbon atoms, Y is NH or 0, $a$ has a value from 0 to 1, $b$ has a value from 1 to 2 with the sum of $a$ and $b$ not exceeding 2, and $z$ has a value from 1 to 10.

9. The compound represented by the formula:

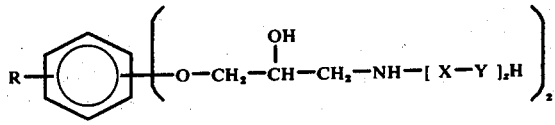

in which R has a molecular weight ranging from 250 to 1200, X is a divalent hydrocarbon radical having from 2 to 6 carbon atoms, Y is NH or 0 and $z$ has a value from 1 to 6.

10. The compound represented by the formula:

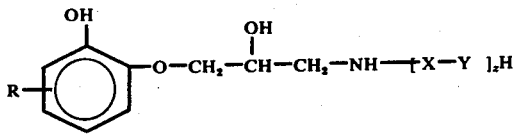

in which R has a molecular weight ranging from 250 to 1200, X is a divalent hydrocarbon radical having from 2 to 6 carbon atoms, Y is NH or 0 and $z$ has a value from 1 to 6.

11. The compound represented by the formula:

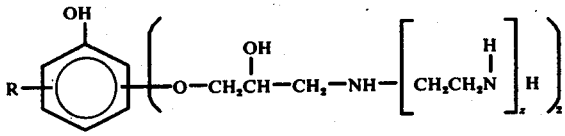

in which R has a molecular weight ranging from 300 to 1000 and $z$ has a value from 2 to 5.

* * * * *

Notice of Adverse Decision in Interference

In Interference No. 100,430, involving Patent No. 4,024,083, M. S. Kablaoui and J. B. Biasotti, SUBSTITUTED PHENOXY PROPANOL DIAMINES AND AMINO ALCOHOL DETERGENT ADDITIVES FOR FUELS AND MINERAL OILS, final judgment adverse to the patentees was rendered Sept. 16, 1981, as to claims 1, 3, 4, 7 and 8.

[*Official Gazette November 3, 1981.*]